US005298116A

United States Patent [19]

Werthmann et al.

[11] Patent Number: 5,298,116

[45] Date of Patent: Mar. 29, 1994

[54] PROCESS FOR PRODUCING A MATTED EMBOSSING SURFACE FOR AN EMBOSSING TOOL FOR MAKING PRESS-FORMED LAMINATES

[75] Inventors: Wilfried Werthmann, Krefeld; Manfred Posselt, Nettetal, both of Fed. Rep. of Germany

[73] Assignee: Standex International Engraving GmbH, Viersen, Fed. Rep. of Germany

[21] Appl. No.: 946,492

[22] PCT Filed: Nov. 28, 1991

[86] PCT No.: PCT/EP91/02304

§ 371 Date: May 24, 1993

§ 102(e) Date: May 24, 1993

[87] PCT Pub. No.: WO92/19461

PCT Pub. Date: Nov. 12, 1992

[30] Foreign Application Priority Data

Apr. 29, 1991 [DE] Fed. Rep. of Germany ..... 4113937

[51] Int. Cl.[5] ..... B44C 1/22

[52] U.S. Cl. ..... 156/645; 156/654; 156/905

[58] Field of Search ..... 156/645, 651, 654, 659.1, 156/664, 209, 220, 219, 905; 101/32; 428/385

[56] References Cited

U.S. PATENT DOCUMENTS

| | | | |
|---|---|---|---|
| 4,213,819 | 11/1980 | Werthmann | 156/660 |
| 4,321,105 | 3/1982 | Melanio et al. | 156/905 X |
| 4,557,778 | 12/1985 | Held | 156/209 |
| 4,582,566 | 4/1986 | Grey et al. | 156/651 |
| 4,787,837 | 11/1988 | Bell | 425/385 |

*Primary Examiner*—William A. Powell

*Attorney, Agent, or Firm*—Townsend and Townsend Khourie and Crew

[57] ABSTRACT

For improved quality and use characteristics, before matting, a fine, randomly oriented sub-structure is applied to the press surface of an embossing surface of an embossing tool for embossing the surface of press-formed laminates or the like. The sub-structure is preferably so fine that, after matting, it is no longer recognizable as such. The matting is produced by either mat chromium plating or by sandblasting and subsequent mat chromium plating. The sub-structure is formed in a one- or multiple-step etching process.

3 Claims, No Drawings

PROCESS FOR PRODUCING A MATTED EMBOSSING SURFACE FOR AN EMBOSSING TOOL FOR MAKING PRESS-FORMED LAMINATES

BACKGROUND OF THE INVENTION

The invention relates to a process for producing a matted embossing surface for an embossing tool with which the surface of press-formed laminates or the like is made by means of mat chromium plating or by means of sandblasting and subsequent mat chromium plating.

Today, furniture surfaces are made on a large scale with melamine resin coated components. Such surfaces, whether on laminated wooden boards or high-pressure laminated panels, are made in hydraulic presses by applying heat and pressure, using special tools, so-called press plates, which are pressed against the material between them and thereby generate the desired surfaces. The surface configuration of the material being pressed is formed during the pressing step so that the finished surface is a true mirror image of the press plate surface.

Surface laminated wooden boards and laminated panels are demanded in many surface configurations. They include patterned, embossed and smooth surfaces, with gloss grades varying from matte to high-gloss. To produce them, appropriate embossing tools or embossing plates must be made available.

Aesthetically and texturally or haptically satisfactory results are attained when producing smooth surfaces having medium- to high-gloss finishes. However, surfaces pressed with matted press plates have an artificial and cold appearance, and they also feel cold when touched. In the production of press plates having a smooth matted surface, a flat, smooth press plate is first ground and polished, is then matted by means of sandblasting or electrolytic mat chromium plating, and is subsequently hard chrome plated. Besides the unsatisfactory aesthetic and textural characteristics of the surface finish obtained in this manner, matted press plates of this type have the disadvantage that the embossing surface is very sensitive to scratches, and fingerprints cannot readily be removed and remain clearly visible on the finished panels produced in this manner.

The present invention proceeds from the assumption that it is known from German DE-AS 27 06 947 or German Patent Specification 31 20 351, for example, to use embossing rolls and an etching process to generate surface structures on the press plates. With the etching process, single or multiple layered surface structures can be formed by applying the etching material onto the press plate with a patterned engraving roll and etching after each application. As a rule, the surface is subsequently polished and matted by sandblasting. The structured pattern can be freely chosen and includes, for example, fine structures, ribbings, naps, or wood grain.

SUMMARY OF THE INVENTION

In contrast, the present invention provides a process for the production of a substantially improved matted press surface for such an embossing tool, so that panels having a dull finish manufactured therewith are texturally and aesthetically satisfactory, do not appear artificial and cold, and are insensitive to fingerprints.

This problem is solved according to the invention by giving the embossing surface a fine, non-directional 10 μm to 25 μm deep base or sub-structure and subsequently matting it in such a way that the gloss grade measured on the Lange reflectometer at 60° is 6 to 16 points.

Surprisingly, furniture surfaces can be produced with an embossing surface made in this manner which, despite optically and texturally creating the impression of smooth surfaces, have the desired characteristics. These include that they no longer appear so artificial, they give a warmer impression, they are relatively insensitive to fingerprints, and, indeed, they feel warmer when touched due to air in the indentations of the structure, which has an insulating effect on the surface of the skin.

DESCRIPTION OF THE PREFERRED EMBODIMENTS

The depth of the sub-structure and the matting are selected and coordinated with one another so that the substructure is no longer recognizable as such after matting. A shallower depth is inappropriate for the sub-structure because it would lead to a practically smooth surface, and with a depth of over 25 μm, the sub-structure would remain undesirably visible after matting. Matting with a gloss grade above 16 points is likewise undesirable, because it leaves the sub-structure visible. However, within the stated limits, the depth of the sub-structure can be varied and a matting adapted thereto can be applied, the choice depending on how pronounced the textural characteristic of the surface is to be and what aesthetic effect is intended for the surface.

The sub-structure can be formed in accordance with one of the known structuring methods. Particularly suited is etching which has hitherto been used for embossing surface configurations which give the surface of the finished panel its actual aesthetic effect. In contrast to this, generating the extremely fine sub-structure according to the present invention is only an intermediate step which is followed by further surface processing. Etching is performed either once or in multiple steps with different surface configurations; e.g. with coarsely and finely structured engraving rolls. Following etching, the press plate is electrolytically or mechanically polished and then matted. Matting can be done in a single step by mat chromium plating or in two steps by first sandblasting and then mat chromium plating. The surface is then hard chrome plated for its protection. With single or multiple step etching as well as single or multiple step matting, the textural effect and the appearance can be varied as desired or required.

What is claimed is:

1. A method for producing a matted embossing surface for an embossing tool used for embossing a surface of press-formed laminates by mat chromium plating or by sandblasting and subsequently mat chromium plating, forming a fine, non-oriented 10 μm to 25 μm deep sub-structure on the embossing surface prior to matting and thereafter finely matting the surface so that its gloss level measured on the Lange reflectometer at 60° is 6 to 16 points.

2. A method according to claim 1, wherein the substructure is formed by etching, and wherein the etching is carried out in multiple stages.

3. A method according to claim 1 wherein the substructure is formed by etching, and wherein the etching is carried out in a single stage.

* * * * *